US005661872A

United States Patent [19]

Meyer et al.

[11] Patent Number: 5,661,872

[45] Date of Patent: Sep. 2, 1997

[54] PROCESS AND APPARATUS FOR CLEANING WORKPIECES BY MEANS OF A JET OF COMPRESSED AIR

[75] Inventors: Otfried Meyer, Nideggen; Karl-Heinz Wüller, Simmerath, both of Germany

[73] Assignee: Durr GmbH, Stuttgart, Germany

[21] Appl. No.: 502,898

[22] Filed: Jul. 17, 1995

[30] Foreign Application Priority Data

Jul. 21, 1994 [DE] Germany ..... 44 25 765.1

[51] Int. Cl.[6] ..... A47L 5/00

[52] U.S. Cl. ..... 15/309.2; 15/316.1; 15/346

[58] Field of Search ..... 15/300.1, 301, 15/302, 303, 306.1, 309.2, 316.1, 346; 134/72, 129, 131; 198/690.2

[56] References Cited

U.S. PATENT DOCUMENTS

| | | | |
|---|---|---|---|
| 4,411,038 | 10/1983 | Mukai | 15/309.2 |
| 5,316,030 | 5/1994 | Shimizu et al. | 134/131 |
| 5,351,354 | 10/1994 | Hasumi et al. | 15/306.1 |

FOREIGN PATENT DOCUMENTS

| | | |
|---|---|---|
| 158904 | 10/1985 | European Pat. Off. . |
| 135 857 | 6/1979 | German Dem. Rep. . |
| 8019194 | 12/1980 | Germany . |
| 3419028A1 | 11/1985 | Germany . |
| 3710367A1 | 10/1988 | Germany . |
| 3734200A1 | 4/1989 | Germany . |
| 9102499 U | 5/1991 | Germany . |

*Primary Examiner*—Tony G. Soohoo

*Attorney, Agent, or Firm*—Leydig, Voit & Mayer, Ltd

[57] ABSTRACT

Process and apparatus for cleaning workpieces by means of at least one jet of compressed air, in which the workpiece is brought into a cleaning station, a high-pressure stream of air is generated by means of a high-pressure air pump, this stream of air is supplied to a blast nozzle directed onto the workpiece and waste air fed back to the suction side of the pump via a filter, wherein to avoid any escape of waste air laden with impurities into the surroundings the workpiece is cleaned in a chamber closed so as to be at least essentially air-tight apart from an air inlet in the form of the blast nozzle as well as a waste air outlet and the air is circulated in a closed air circulation system including the chamber and wherein solid particles are mechanically filtered out of the stream of air upstream of the pump.

11 Claims, 2 Drawing Sheets

PROCESS AND APPARATUS FOR CLEANING WORKPIECES BY MEANS OF A JET OF COMPRESSED AIR

Workpieces, in particular those which are machined by grinding, boring, milling and the like, require a thorough cleaning in many cases to remove cuttings, abrasive grains but also residues of machining fluids, such as cutting and cooling oils, or other machining residues as completely as possible.

Up until now, such cleaning took place, in practice, almost exclusively by the workpieces being cleaned with a cleaning liquid (organic solvents or aqueous cleaning liquids containing surfactants) by spraying and/or dipping and subsequently being dried. The cleaning and/or drying takes place workpiece by workpiece or in batches in a treatment chamber which has a loading and unloading opening sealingly closable by means of a cover and is part of a closed air circulation system, in which the air circulated for the drying has had water and solvent vapor absorbed by the drying air removed from it, for example, by condensation and adsorption in order to avoid any pollution of the ambient air, e.g. the atmosphere of a factory workshop, by moisture or harmful solvent vapors. These cleaning processes and apparatuses which are more or less free from waste air lead to excellent cleaning results.

A primitive type of workpiece cleaning without the use of a cleaning liquid is common, in particular, in metalworking factories: Following machining, the workpiece is manually blasted by means of a compressed air nozzle with the result that cuttings and other machining residues are blown into the surrounding air which leads to an extremely troublesome soiling of the working area. For this reason, it is also already state of the art to provide a cleaning chamber with a waste air opening provided with a filter. A workpiece to be cleaned is introduced into this chamber and in it it is cleaned by means of one or more compressed air nozzles which are fed from a compressed air factory network, whereby the waste air escapes into the factory workshop via the filter. This type of workpiece cleaning does represent an improvement over the type of cleaning described beforehand with a manually operated compressed air nozzle; however, since the waste air is generally laden with machining residues, despite the filter, e.g. with vapors of a cooling and/or cutting liquid used during the machining, this also leads to a pollution of the atmosphere in the workshop. Furthermore, the two methods have in common the disadvantage of a high consumption of compressed air.

DE-37 10 367-A1 discloses an apparatus for deoiling workpieces by means of several jets of compressed air; this apparatus is also provided for deoiling chipping masses resulting from a removal of metal by cutting, whereby in both cases the apparatus serves the purpose, apart from avoiding the use of cleaning liquids, of recovering the oils removed during blasting and of being able to provide these for reuse. In this known apparatus, the products to be deoiled are placed on a horizontally extending endless conveyor belt which is permeable to air and consists of a wire grating or the like as well as runs through a cleaning station, in which a plurality of blast nozzles designed as slit nozzles are arranged above the conveyor belt and in series in its direction of travel and a bowl-shaped air collection tank is arranged beneath the conveyor belt, namely beneath the blast nozzles. The collection tank and the blast nozzles are parts of an air circulation system which includes a high-pressure air pump in the form of a high-pressure blower upstream of the blast nozzles and an oil separator downstream of the air collection tank and upstream of the high-pressure blower. Each of the blast nozzles extends over the entire transport width of the conveyor belt, and the same applies for the air collection tank. The delivery pressure of the high-pressure blower is in the order of magnitude of 5000 pa, and the air exit velocity at the blast nozzles is intended to be between 30 and 70 m/sec. Although part of the air conveyed from the high-pressure blower is circulated in this known apparatus, it still has, even though to a lesser extent, the disadvantages of the other processes or devices previously described and operating with blast nozzles since waste air laden with machining residues (atomized or vaporized oils or oily fluids as well as powdered solid particles) unavoidably reach the atmosphere in the workshop.

The object underlying the invention was to avoid any appreciable adverse effect on the environment caused by used cleaning liquids or by waste air laden with entrained substances during the cleaning of workpieces.

BRIEF SUMMARY OF THE INVENTION

Proceeding on the basis of an apparatus for cleaning workpieces by means of at least one jet of compressed air which has a cleaning station, in which at least one blast nozzle directed onto a workpiece to be cleaned is arranged, and which, in addition, has an air circulation system which comprises in series in the direction of flow of the air a high-pressure air pump, the blast nozzle and a filter for impurities blown off the workpieces, this object may be accomplished in accordance with the invention in that the cleaning station is provided with at least one chamber for accommodating the workpiece to be cleaned, wherein this chamber is closable so as to be at least essentially air-tight, is provided with the blast nozzle, is designed for the introduction of workpieces to be cleaned and the discharge of cleaned workpieces and has a waste air opening which is part of the air circulation system, and that the filter is designed as a solid particle filter.

Surprisingly, it has been shown that with a correspondingly dimensioned high-pressure air pump and a suitable blast nozzle a jet of compressed air can be generated with an air exit velocity which is sufficient to remove from workpieces virtually all machining residues, such as, e.g., cuttings located in blind holes and other residues originating from metal-cutting machining, whereby any adverse effect on the environment is avoided due to the complete recycling of the air used for the cleaning. Due to the use of a solid particle filter, cuttings, abrasive grains and the like can not only be retained without problem but such a filter can also be easily cleaned again by it being acted upon from its outflow side with a stream of air.

When assessing the inventive solution, it must be borne in mind that until now the experts have quite obviously not given any consideration to the fact that emissions having an adverse effect on the environment are also caused by the waste air during dry cleaning, i.e. during the cleaning of workpieces by means of strong air jets—even in the apparatus according to DE-37 10 367-A1 which is used for deoiling only the avoidance of the use of cleaning liquids and the recovery of the oil are seen as advantages, whereas this apparatus also operates with an open system despite a partial return of the blast air to the high-pressure blower and, consequently, the step towards a system free of waste air is not taken.

It is obvious that the air exit velocity at the blast nozzle is of decisive significance for the quality of the cleaning result. In the cleaning apparatus according to DE-37 10

367-A1 dealing with the deoiling of objects, an air exit velocity of between 30 and 70 m/sec is used. This may lead to a cleaning result during deoiling which is perhaps satisfactory; however, as far as the cleaning tasks, to which the pending invention relates, are concerned, e.g. the removal of cuttings from workpiece contours forming an undercut, threaded bores or blind holes, considerably faster air exit velocities are recommended; for this reason, in a preferred embodiment of the inventive cleaning apparatus, pump capacity and delivery pressure of the high-pressure pump are adjusted to the blast nozzle such that the air exit velocity at the blast nozzle is at least approximately 100 m/sec, even better at least approximately 200 m/sec and best of all at least approximately 250 m/sec. It has also been found that the cleaning results achieved with such air exit velocities are, surprisingly, just as good as in cleaning apparatuses, in which the workpieces are cleaned with the aid of cleaning liquids.

In principle, it would, of course, be conceivable to use in an inventive cleaning apparatus a chamber which has, in the known manner, a loading and unloading opening which can be closed so as to be air-tight by means of a cover; however, since such a chamber not only requires the workpieces to be introduced into the chamber individually or in batches, i.e. operation is discontinuous, but also presupposes a relatively complicated workpiece handling device for loading and unloading the chamber, embodiments of the inventive cleaning apparatus are preferred, in which an endless conveyor element bearing the separate workpieces to be cleaned is provided, the chamber forms a channel with an at least essentially constant cross section in the direction of passage of the workpieces, the endless conveyor element extends through the channel and partitions or dividing walls are attached to the endless conveyor element. These partitions extend transversely to the direction of passage and are arranged in spaced relation to one another in this direction; they are also adapted in their shape to the cross section of the channel such that two partitions together with the channel walls form a respective chamber segment which is closed so as to be at least essentially air-tight. Finally, the blast nozzle is located outside the path of the partitions and is directed into this channel segment. With such a cleaning apparatus, the workpieces can be treated, as required, in continuous operation since such an apparatus forms a treatment chamber, which is closed so as to be at least more or less air-tight, with two respective partitions for each individual workpiece, possibly also for several workpieces arranged one behind the other or next to one another, whereby the blast nozzle or nozzles must, of course, be arranged so that it does not or they do not hinder the movement of the partitions; for this purpose, the blast nozzle is expediently arranged outside the inner surfaces of the channel walls, whereby the blast nozzle opening can be flush with these inner surfaces. However, it would also be possible, in principle, to attach the blast nozzle so as to be movable, e.g. pivotable, transversely to the direction of passage so that it projects into the chamber segment during the cleaning procedure but can be withdrawn from this when a partition is intended to move past the blast nozzle.

The endless conveyor element can have any optional shape as long as it does not interfere with the jet of compressed air generated by the blast nozzle in such a way that the cleaning result is impaired thereby; it would, for example, be conceivable to use as endless conveyor element an endless rope, to which holding devices for the workpieces are attached in spaced relation to one another in the longitudinal direction. As in the cleaning apparatus according to DE-37 10 367-A1, the endless conveyor element can, however, also be a conveyor belt, on which the workplaces are placed and which is permeable to air transversely to the plane of the belt, e.g. because the conveyor belt is formed from a wire structure having relatively large openings. With a view to the fact that in the inventive cleaning apparatus heavier workplaces are also intended to be cleaned without the latter leading to any appreciable sagging of the endless conveyor element, embodiments are recommended, in which the endless conveyor element is formed by a conveyor chain which consists of a plurality of chain links articulatedly connected to one another and on which the workplaces are placed, whereby a plurality of conveyor chains arranged next to one another and extending parallel to one another can, of course, be provided since such a structure is also permeable to air transversely to the direction of passage.

In principle, the blast nozzle arrangement could be chosen like that shown in DE-37 10 367-A1; such an arrangement does, however, have the disadvantage that the jets of compressed air are always directed only in one direction onto the workplaces to be cleaned which often does not lead to optimum cleaning results. For this reason, it is preferable for the blast nozzle to have an air outlet opening at least essentially enclosing the workpiece to be cleaned, whereby the course of the air outlet opening, which is in particular slit-shaped, is advantageously adapted to the workpiece contour—when seen in the direction of passage of the workpieces.

When cleaning during continuous passage of the workpieces is dispensed with, a workpiece could be stopped for its cleaning and the blast nozzle moved, whereby the latter could perform a linear or a pivoting movement since it is, fundamentally, only important for blast nozzle and workpiece to be movable relative to one another transversely to the air outlet opening of the blast nozzle. Embodiments are, however, preferred, in which the workpiece is moved during the cleaning procedure and the blast nozzle is stationary.

With embodiments, in which the blast nozzle has an air outlet opening which at least essentially encloses the workpiece to be cleaned, i.e. is at least more or less ring-shaped, and the workpieces are moved by means of an endless conveyor element, the endless conveyor element should extend through the air outlet opening of the blast nozzle.

In principle, the length of the channel formed by the chamber of the cleaning station could be only slightly greater than the longitudinal space between the partitions or dividing walls attached to the endless conveyor element; this is sufficient when the endless conveyor element is stopped during the actual cleaning procedure or moved only very slowly. However, embodiments are preferred, in which the channel length is considerably greater than the longitudinal distance between two consecutive partitions so that relatively high throughput speeds can be used during operation. Moreover, such an embodiment offers the advantage that the partitions form several channel segments in the channel one behind the other and these segments are closed so as to be at least almost air-tight in order to, if necessary, reduce even further the discharge of waste air into the surroundings and/or to be able to carry out additional workpiece treatments in a closed treatment chamber each time prior to or following the cleaning of the workpieces. For example, it is recommendable to arrange at least one superheated steam jet nozzle directed onto the workpiece to be cleaned upstream of the blast nozzle in order to bring about an even better degreasing or deoiling of the workpieces; the treatment with superheated steam can, however, also take place in the same chamber segment, in which the cleaning is also carried out by means of one or several jets of compressed air, whereby, in this case, it is also recommendable for the superheated steam jet nozzle to be arranged upstream of the blast nozzle in the direction of passage. For the degreasing or deoiling by means of superheated steam it is recommended that a superheated steam jet of approximately 140° C. and 5 bar be used. In this case, it is advantageous for a deoiling of the waste air to be carried out at that point in the air circulation system, at which the solid particle filter is also located, but upstream of this filter or, if necessary, in the same tank, in which the solid particles separated by the filter are also collected.

Furthermore, it can be advantageous to provide a nozzle for anticorrosive agent directed onto the workpiece, this being either a nozzle following on from the blast nozzle in the direction of passage or the blast nozzle itself, whereby in the last-mentioned case a suitable anticorrosive agent is blown into the stream of blast air.

It has proven to be positive for the cleaning result when the high-pressure pump is designed such that it delivers at least approximately 600 $m^3/h$ per blast nozzle, and a lateral channel compressor is preferably used as high-pressure pump—lateral channel compressors of this type are known and available on the market and so there is no necessity to describe such a compressor in greater detail.

To avoid having to exchange the solid particle filter after a certain operating time and to be able to discharge solid particles separated by the filter easily from the apparatus, it is recommendable to arrange the filter in a dirt collecting tank in the region of an outflow end of this tank, to provide the dirt collecting tank downstream of the filter with a compressed air inlet and opposite thereto with a closable dirt discharge opening as well as to provide an inlet for the waste air coming from the chamber between filter and dirt discharge opening on the dirt collection tank. Such a construction allows the filter to be acted upon with compressed air contrary to the normal throughflow direction and thus to remove from the filter solid particles, such as cuttings and the like, retained by the filter and expel these from the collecting tank via the dirt discharge opening therein. This procedure can easily be automated by measuring the drop in pressure across the filter or the pressure downstream of the high-pressure pump of the stream of high-pressure air generated thereby, switching off the pump for a short time, opening the dirt discharge opening of the dirt collecting tank and acting on the outflow side of the filter with compressed air when the drop in pressure at the filter exceeds a certain amount or the pressure behind the high-pressure pump falls below a predetermined value.

As is apparent from the aforesaid, the subject matter of the invention is also a process for cleaning workpieces by means of at least one jet of compressed air, wherein the workpiece is brought into a cleaning station, a stream of high-pressure air is generated by means of a high-pressure air pump, this stream of air is supplied to a blast nozzle directed onto the workpiece and waste air is fed back to the suction side of the pump via a filter, wherein, in accordance with the invention, the workpiece is cleaned in a chamber closed so as to be at least essentially air-tight apart from an air inlet in the form of the blast nozzle as well as a waste air outlet and the air is circulated in a closed air circulation system including the chamber, and wherein, in addition, solid particles are mechanically filtered out of the stream of air upstream of the pump.

Apart from the advantages already mentioned in the above, the invention also leads to the fact that a high consumption of compressed air taken from a factory network can be avoided and that the operation of the high-pressure pump is more energy-saving since all the air supplied by the later is fed back to the suction side of the pump again and the high-pressure pump need not suck in and compress any appreciable amounts of ambient air. In this connection, it should also be mentioned that due to compression of the circulated air in the high-pressure pump this air is heated and so heated air is supplied to the blast nozzle which has a positive effect on the cleaning result, namely not only with respect to any deoiling or degreasing which may be necessary but also when the workpieces to be cleaned or the cleaned workpieces have also to be dried for any reason.

As is shown by the aforesaid, it is also within the scope of this invention to use the cleaning apparatus not only as a pure dry cleaning apparatus—following a preceding wet cleaning it is possible to dry the workpieces with the inventive apparatus and, if necessary, carry out subsequent cleaning; an inventive apparatus can, however, also be easily designed such that in it the workplaces are first of all subjected to a preliminary dry cleaning, then subsequently cleaned by means of a cleaning liquid and finally dried, whereby those embodiments are, in particular, recommendable, in which a plurality of closed channel segments are formed in a channel formed by the chamber by means of partitions.

BRIEF DESCRIPTION OF THE DRAWINGS

Further features, advantages and details of the invention result from the following description and the attached drawings of a particularly advantageous embodiment of the inventive cleaning apparatus; in the drawings.

DESCRIPTION OF THE PREFERRED EMBODIMENTS

Figure 1:
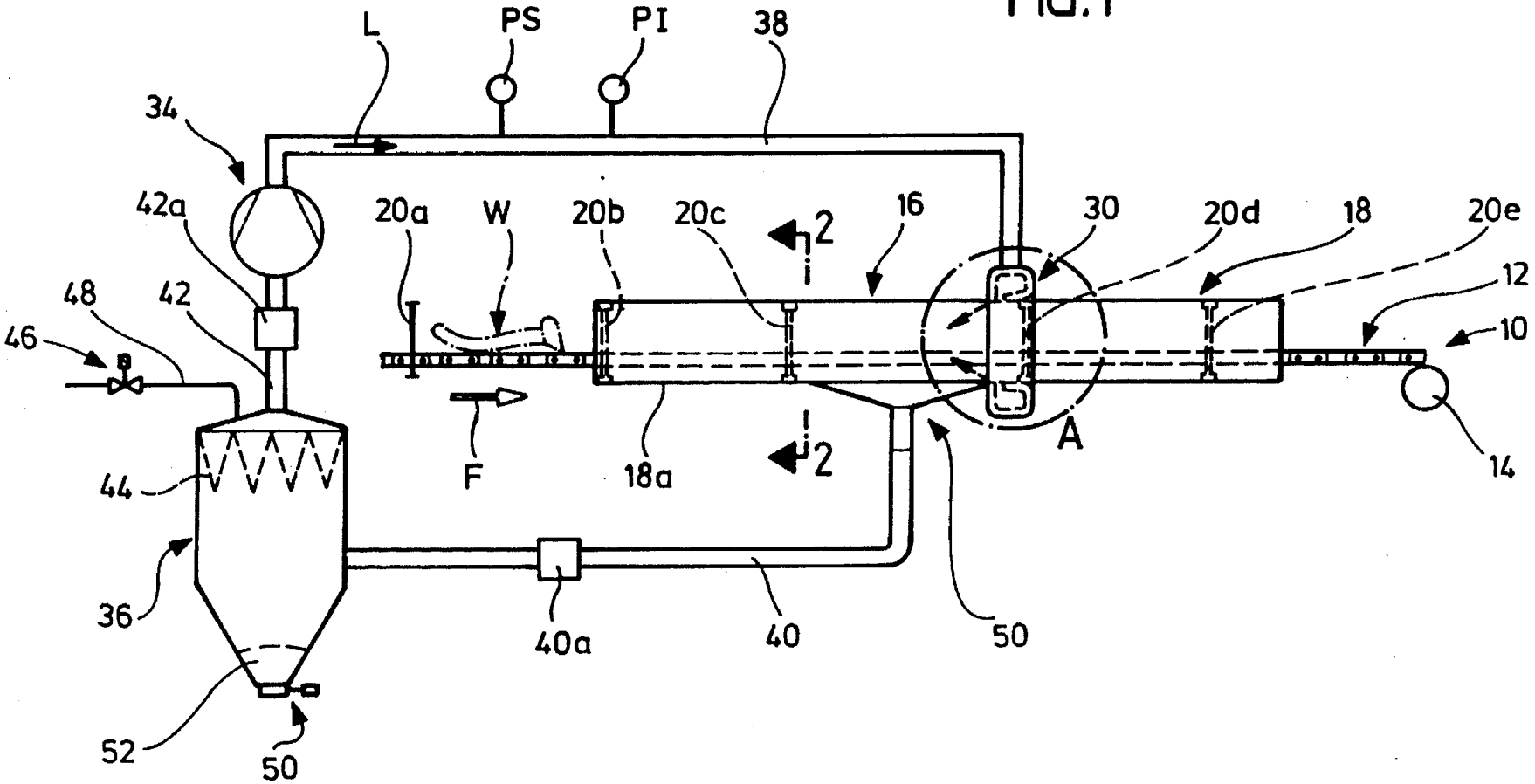
FIG. 1 is a schematic illustration of the cleaning apparatus.

FIG. 1 shows parts of a conveyor designated as a whole as 10, of which only the upper half 12 of an endless conveyor chain and a support or deflecting roller 14 (which can also, if necessary, be a drum) are illustrated.

Figure 2:
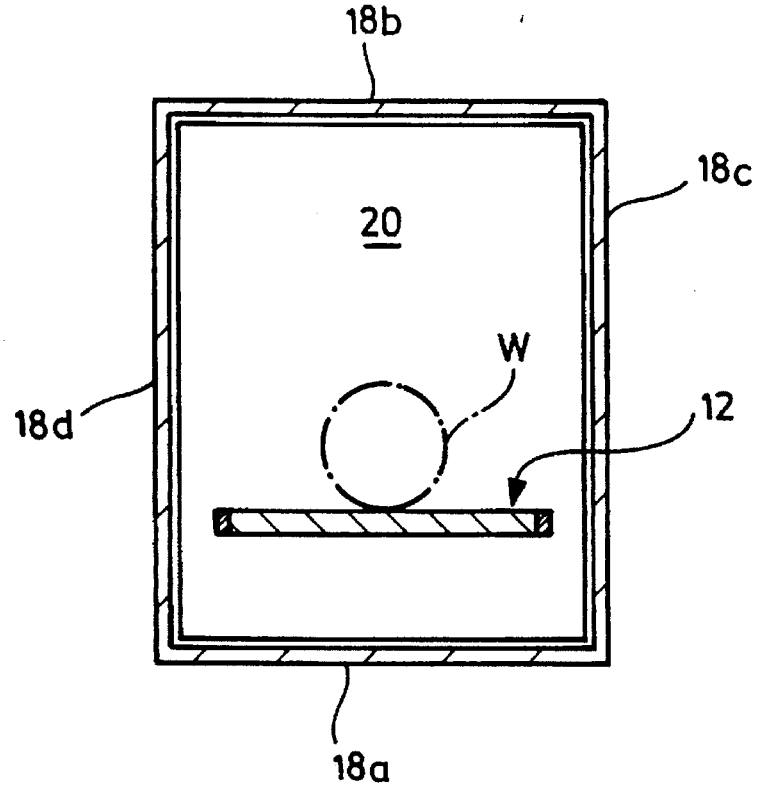
FIG. 2 shows a section along line 2—2 in FIG. 1.

A cleaning station 16 has an elongated, straight channel 18 which is open at front and back, i.e. to the left and right according to FIG. 1, has a rectangular cross section (cf. FIG. 2) with a constant cross-sectional area and shape over its entire length and the walls of which are closed overall except for a place which has still to be described. The upper half 12 of the endless conveyor chain runs through this channel 18, and such that dividing walls or partitions rigidly secured to the conveyor chain can pass through the channel 18. FIG. 1 shows only a few of these dividing walls or partitions, namely the partitions 20*a*, 20*b*, 20*c*, 20*d* and 20*e*, which, like all the other partitions secured to the conveyor chain and not illustrated, are arranged at the same distances from one another and are of an identical design. In accordance with the invention, each partition is intended to be adapted to the channel cross section formed by smooth inner surfaces of the channel 18 such that it, as long as it is located in the channel 18, abuts against the inner surfaces of the channel side walls so as to be at least almost air-tight (if necessary, with the aid of sliding seals attached to the partition edges and not illustrated) so that two consecutive partitions located within the channel 18 form each time together with the channel walls a chamber, referred to in the following as channel segment, which is closed so as to be at least almost air-tight. For this purpose, each partition forms a gas-impermeable wall, through which the conveyor chain also extends in a gas-tight manner.

Furthermore, the upper half 12 of the conveyor chain runs, in accordance with the invention, at only a slight distance above the lower wall 18*a* of the channel 18 so that workpieces to be cleaned can be placed on the upper half 12 of the conveyor chain and thus be conveyed through the channel 18. The direction of conveyance or the running direction of the upper half 12 of the conveyor chain has been indicated in FIG. 1 by the arrow "F", and a workpiece "W" to be cleaned is apparent in FIG. 1 to the left of the channel 18; a workpiece has likewise been indicated in FIG. 2 by a dash-dot line.

Figure 3:
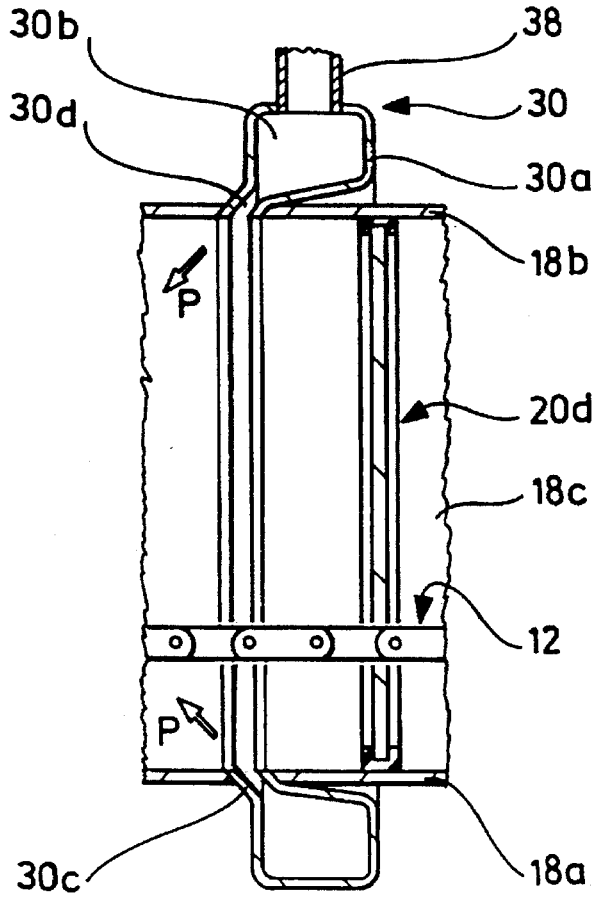
FIG. 3 shows the section designated "A" in FIG. 1 on a larger scale than in FIG. 1.

FIG. 3 shows a blast nozzle already indicated in FIG. 1 and designated as a whole as 30 in all its details. This blast nozzle has an annular nozzle body 30*a*, which extends around the channel 18 and forms a self-contained annular cavity 30*b*. Moreover, the nozzle body 30*a* forms an, again, annular outlet nozzle 30*c* with a likewise annular nozzle slit 30*d*, which is the outlet opening of the blast nozzle 30. As is apparent from FIG. 3, the nozzle slit 30*d* extends around the entire channel 18 because the outlet nozzle 30*c* is inserted into the lower wall 18*a*, the upper wall 18*b* and the two side walls 18*c* and 18*d* of the channel 18 and is flush with the smooth inner surfaces of the channel walls. In accordance with the invention, the outlet nozzle 30*c* and, with it, the nozzle slit 30*d* is inclined in relation to the longitudinal direction of the channel 18, namely contrary to the direction of conveyance F, whereby it has proven to be expedient to select this inclination such that the jets of compressed air P exiting from the blast nozzle 30 (cf. FIG. 3) form an angle in the order of magnitude of 10° to 30° and preferably of approximately 15° with a plane oriented vertically to the direction of conveyance F.

The air circulation system of the inventive cleaning apparatus will now be explained on the basis of FIG. 1.

This comprises, apart from the blast nozzle 30, a high-pressure air pump 34, a region of the channel 18 which will be discussed in greater detail later on, a silo-like dirt collecting tank 36 as well as connecting pipes 38, 40 and 42. The direction of conveyance of the high-pressure pump 34 has been indicated by arrow L.

Just in front of the connecting pipe 42 the collecting tank 36 contains a solid particle filter 44 designed in particular in the shape of a screen; above this filter, i.e. on its outflow side, a compressed air line 48 provided with a valve 46 opens into the collecting tank 36; at the bottom the collecting tank is provided with a slide valve 50, by means of which a dirt discharge opening can be formed, and approximately in the central region of the collecting tank the connecting pipe 40 opens into it. Collected dirt has been indicated in FIG. 1 at 52; this has been separated out of the circulated stream of air by the filter 44 and has already dropped from the filter.

The connecting pipe 40 contains a valve 40*a*, the connecting pipe 42 a valve 42*a* and the connecting pipe 38 a pressure switch PS as well as a manometer PI.

Upstream of the blast nozzle 30, the floor of the channel 18 is designed as a funnel 50, whereby the longitudinal extension, measured in the direction of conveyance F, of the constructional unit consisting of the blast nozzle 30 and the funnel 50 is clearly smaller than the longitudinal distance between two partitions of the conveyor 10. The connecting pipe 40 opens into the bottom of this funnel 50 whereas the connecting pipe 38 opens into the blast nozzle 30.

In the illustrated, preferred embodiment of the inventive cleaning apparatus, the high-pressure pump 34 is a so-called lateral channel compressor with a power in the order of magnitude of 10 kW, a pump capacity of approximately 750 $m^3/h$ and a delivery pressure of approximately 200 mbar. The volume of the dirt collecting tank 36 is approximately 150 l, and the filter 44 is designed such that the maximum filter load (air throughput volume) is in the order of magnitude of 800 $m^3/h$. Moreover, it has proven to be expedient to select a conveying velocity of the conveyor 10 of approximately 1 m/min or somewhat less.

One of the deflecting rollers or drums of the conveyor 10 must, of course, be driven, e.g. the deflecting roller 14 illustrated in FIG. 1.

The mode of operation of the cleaning apparatus as described is as follows:

The workpieces W to be cleaned which are placed on the conveyor 10 one behind the other and several of which can also be arranged, if required, between two respective partitions, run into the channel 18 and are cleaned during their passage with the aid of the blast nozzle 30, i.e. by the streams of compressed air P generated by the latter; solid particles, such as, for example, cuttings but also blown-off oil and, possibly, grease remains, thereby removed from the workpieces pass into the funnel 50 together with the waste air and, from there, into the connecting pipe 40. Since, in the meantime, the two partitions 20*c* and 20*d* shown in FIG. 1 cover only a distance, according to which the partition 20*d* migrates to the right according to FIG. 1 from the nozzle slit 30*d* and the partition 20*c* coming from the left does not move quite as far as the left end of the funnel 50, the waste air together with all the impurities blown off the workpiece passes into the funnel 50 and therefore into the connecting pipe 40—during the cleaning procedure the valves 40*a* and 42*a* are open while the valve 46 and the slide valve 50 are closed. The filter 44 separates the solid particles out of the stream of air circulated with the aid of the high-pressure pump 34 whereas oil residues are separated out of the stream of air beforehand with the aid of an oil separator which is not illustrated (suitable oil separators, such as, for example, an electrostatic separator, are known from the state of the art). Subsequently, the waste air is recompressed by the high-pressure pump 34 and conveyed to the blast nozzle 30.

Always when a partition travels over the nozzle slit 30*d* the cleaning procedure begins in the next chamber segment, i.e. the cleaning of the next workpiece.

When the flow resistance of the filter 44 becomes too great as a result of considerable soiling, the pressure switch PS is activated, whereupon an apparatus control, which is not illustrated, switches off the high-pressure pump 34, closes the valves 40*a* and 42*a* and opens the valve 46 as well as the slide valve 50 which causes cleaning of the filter 44 by backflushing and discharge of the dirt collected in the collecting tank 36 through the slide valve 50. The valves 46 and 50 are then closed, the valves 40*a* and 42*a* opened and the high-pressure pump 34 restarted so that the cleaning process can be continued. During such a cleaning of the filter 44, the conveyor 10 is likewise expediently switched off.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. Apparatus for cleaning workpieces by means of at least one jet of air, said apparatus comprising:

a longitudinal channel for passing workpieces therethrough in a workpiece travelling direction, said channel having two open ends and a cleaning channel section between said ends, said cleaning channel section having sidewalls circumscribing an interior of said channel section in a circumferential direction thereof and defining an inside cross section of said channel section, said inside channel cross section being at least approximately constant along said cleaning channel section;

an endless conveyer with an endless conveyer element extending through said channel for carrying workpieces arranged separately from one another through the channel;

drive means for causing said endless conveyer element to travel through the cleaning channel section in said workpiece travelling direction;

partitions attached to said endless conveyer element for moving the partitions through the channel, said partitions extending generally transversely to a longitudinal direction of said conveyer element and being disposed one behind the other along said conveyer element in such spaced relationship that at least one workpiece to be cleaned can be disposed between two consecutive partitions, said partitions having a shape matching with said inside channel cross section such that two consecutive partitions travelling through the cleaning channel section, together with said channel sidewalls, form a cleaning chamber travelling through the cleaning channel section and being at least essentially airtight;

at least one blast nozzle for directing an air jet into the interior of the cleaning channel section and onto the workpieces to be cleaned, said blast nozzle being arranged at said cleaning channel section such as to avoid a collision between said travelling partitions and said blast nozzle;

a high-pressure air pump for feeding said blast nozzle with pressurized air;

a waste air outlet opening in at least one of the sidewalls of said cleaning channel section;

a filter for retaining solid impurity particles blown off the workpieces to be cleaned, and air conducting means between an air outlet of said pump and an air inlet of said blast nozzle, between said waste air outlet opening of said cleaning channel section and a waste air inlet of said filter, and between an air outlet of the filter and an air inlet of said pump for providing an air circulation system.

2. The apparatus of claim 1, wherein said air pump has an air volume feed rate capacity and an air pressure capacity to produce an air jet having a velocity of at least approximately 100 m/s when leaving said blast nozzle.

3. The apparatus of claim 1, wherein said air pump has an air volume feed rate capacity and an air pressure capacity to produce an air jet having a velocity of at least approximately 200 m/s when leaving said blast nozzle.

4. The apparatus of claim 1, wherein said air pump has an air volume feed rate capacity and an air pressure capacity to produce an air jet having a velocity of at least approximately 250 m/s when leaving said blast nozzle.

5. The apparatus of claim 1, wherein at least part of said air jet is directed into said cleaning chamber in a direction transverse to the workpiece travelling direction, and wherein said endless conveyer element is permeable to air directed transverse to the workpiece travelling direction.

6. The apparatus of claim 1, wherein said blast nozzle has a housing with an air outlet opening at least substantially encircling a workpiece to be cleaned, and wherein said workpiece and said blast nozzle are each movable relative to the other in the longitudinal direction of the conveyer element.

7. The apparatus of claim 1, wherein said air outlet opening encircles the endless conveyer element.

8. The apparatus of claim 1, wherein the partitions form a series of cleaning chambers within said cleaning channel section.

9. The apparatus of claim 1, wherein said air pump has an air volume feed rate capacity of at least about 600 $m^3/h$ per blast nozzle.

10. The apparatus of claim 1, wherein said air pump is a lateral channel compressor.

11. The apparatus of claim 1, wherein said air circulation system includes a dirt collecting tank having a waste air inlet opening and an air outflow region with an air outlet opening, said filter having a filter element being arranged within said air outflow region, said dirt collecting tank also having a compressed air inlet downstream of said filter element and a closable dirt discharge opening upstream of the filter element, said waste air inlet opening being provided between the filter element and said dirt discharge opening.

* * * * *